US005837385A

United States Patent [19]

Schaeffer et al.

[11] Patent Number: 5,837,385

[45] Date of Patent: Nov. 17, 1998

[54] ENVIRONMENTAL COATING FOR NICKEL ALUMINIDE COMPONENTS AND A METHOD THEREFOR

[75] Inventors: Jon C. Schaeffer, Milford; David F. Lahrman, Powell, both of Ohio

[73] Assignee: General Electric Company, Cincinnati, Ohio

[21] Appl. No.: 829,295

[22] Filed: Mar. 31, 1997

[51] Int. Cl.[6] ..... B32B 15/04; F01D 5/28; C23C 10/28; C23C 10/60

[52] U.S. Cl. ..... 428/610; 428/629; 428/680; 148/277; 148/537; 416/241 R

[58] Field of Search ..... 428/621, 629, 428/680, 678, 652, 651, 610; 148/518, 277, 537; 416/241 R, 241 B

[56] References Cited

U.S. PATENT DOCUMENTS

| | | | |
|---|---|---|---|
| 3,874,901 | 4/1975 | Rairden, III | 117/71 M |
| 3,880,550 | 4/1975 | Corey et al. | 415/174 |
| 4,123,594 | 10/1978 | Chang | 428/651 |
| 5,057,196 | 10/1991 | Creech et al. | 204/181.5 |
| 5,302,465 | 4/1994 | Miller et al. | 428/552 |
| 5,413,871 | 5/1995 | Nelson et al. | 428/552 |
| 5,500,252 | 3/1996 | Meelu | 427/376.3 |
| 5,514,482 | 5/1996 | Strangman | 428/623 |
| 5,650,235 | 7/1997 | McMordie et al. | 428/610 |

*Primary Examiner*—John J. Zimmerman
*Attorney, Agent, or Firm*—Andrew C. Hess; David L. Narciso

[57] ABSTRACT

An environmental coating and a method for forming the coating on a nickel aluminide component designed for use in a hostile thermal environment, such as turbine, combustor and augmentor components of a gas turbine engine. The environmental coating includes a metal that has been diffused into the surface of the nickel aluminide component, and an aluminum oxide layer on the surface of the nickel aluminide component. According to this invention, the metal is one or more noble metals, chromium and/or an MCr alloy, and forms a diffusion region comprising noble metal-aluminides and/or chromium-aluminides. The environmental coating optionally contains up to about 1.0 atomic percent of at least one oxygen-active element, such as yttrium, hafnium, zirconium and/or cerium. According to the invention, the environmental coating need only consist of the diffusion region and the aluminum oxide layer, and therefore does not require additional environmentally-resistant layers (e.g., diffusion aluminides or MCrAlY coatings) to protect the underlying nickel aluminide substrate.

17 Claims, 1 Drawing Sheet

ENVIRONMENTAL COATING FOR NICKEL ALUMINIDE COMPONENTS AND A METHOD THEREFOR

This invention relates to components formed from nickel aluminide alloys and designed for use in a hostile thermal environment, such as that of a gas turbine engine. More particularly, this invention is directed to environmental coatings for improving the hot corrosion resistance of nickel aluminide components during exposure to operating conditions of a gas turbine engine in which attack by hot corrosion occurs.

BACKGROUND OF THE INVENTION

Higher operating temperatures for gas turbine engines are continuously sought in order to increase their efficiency. However, as operating temperatures increase, the high temperature durability and environmental resistance of the engine components must correspondingly increase. Significant advances in high temperature and environmental properties have been achieved through formulation of nickel and cobalt-base superalloys, though such alloys alone are often inadequate to form components located in certain sections of a gas turbine engine, such as the turbine, combustor and augmentor. A common solution is to protect these components from their hostile environments with coatings.

Environmental coatings for high temperature components generally include an environmentally-resistant metallic coating that is deposited on the component surface. These coatings are known as thermal barrier coatings if an adherent ceramic layer is deposited on the metallic coating (termed a bond coat) to thermally insulate the component. Bond coats are typically formed from an oxidation-resistant aluminum-based intermetallic such as a diffusion aluminide or platinum aluminide, or by an oxidation-resistant aluminum-containing alloy such as MCrAlY (where M is iron, cobalt and/or nickel). The aluminide coatings are intermetallics as a result of the diffusion of aluminum into the surface of the superalloy (aluminizing), while the MCrAlY coatings are mixtures of metallic phases deposited on the superalloy surface.

Bond coats formed with the above-noted above compositions protect the underlying superalloy substrate by forming an oxidation barrier for the underlying superalloy substrate. The aluminum content of the bond coat materials provides for the growth of a strong adherent continuous aluminum oxide layer (alumina scale) that protects the bond coat from oxidation and hot corrosion and, if present, chemically bonds the ceramic layer to the bond coat. Though bond coat materials are particularly alloyed to be oxidation-resistant, oxidation inherently occurs over time at elevated temperatures, which gradually depletes aluminum from the bond coat. Eventually, the level of aluminum within the bond coat is sufficiently depleted to prevent further growth of oxide, at which time spallation may occur at the interface between the bond coat and the aluminum oxide layer or the interface between the oxide layer and the ceramic layer.

Due to their advantageous mechanical and physical properties, nickel aluminide alloys such as NiAl and $Ni_3Al$ have become of interest for forming certain structural components of gas turbine engines. While exhibiting excellent oxidation resistance as a result of their ability to form and maintain a protective alumina scale, the operating conditions within a gas turbine engine have been found to substantially reduce the ability of the alumina scale to protect an NiAl component from hot corrosion. In particular, oxygen drawn into the engine, sodium from the ingestion of sea air, and sulfur as an impurity in jet fuel, react to form salts such as $Na_2SO_4$, which render the alumina scale on an NiAl component nonprotective, leading to hot corrosion attack. Testing has shown that hot corrosion can be responsible for degrading the mechanical properties of NiAl components exposed to elevated temperatures in which salt is present. The loss of mechanical properties by wall consumption can be dramatic, and can cause NiAl components to have a service life that is considerably shorter than nickel-base superalloys subjected to identical conditions. This extreme susceptibility of NiAl alloys to hot corrosion occurs even though the protective alumina scale could be maintained by the large reservoir of aluminum available from the NiAl alloy.

From the above, it is apparent that the service life of an NiAl alloy component is dependent on providing environmental protection from hot corrosion under conditions where an alumina scale is insufficient. However, there is little prior art for environmental coatings on NiAl alloys, particularly since such alloys have in the past been limited to being the oxidation-resistant intermetallic phase of prior art bond coats on superalloys, i.e., the NiAl alloys themselves were relied on for providing environmental resistance for other alloys.

SUMMARY OF THE INVENTION

It is an object of this invention to provide an environmental coating for nickel aluminide alloys, and a method for forming such a coating on an NiAl component designed for use in a hostile thermal environment in which the component is prone to degradation by hot corrosion attack.

It is another object of this invention that the coating does not require an aluminizing process or aluminum-containing coating as required by prior art environmental coatings.

It is yet another object of this invention that the coating contributes minimal weight to the component.

It is a further object of this invention that the coating can serve as a bond coat for a thermal insulating ceramic layer.

The present invention generally provides an environmental coating and a method for forming the coating on a nickel aluminide component designed for use in a hostile thermal environment, such as turbine, combustor and augmentor components of a gas turbine engine. The method is particularly directed to increasing the hot corrosion resistance of an NiAl component that is subjected to deposits of salts, such as $Na_2SO_4$, as a result of the operating environment of the component. Nickel aluminides of particular interest to this invention include single-crystal binary NiAl alloys that consist essentially of nickel and aluminum in stoichiometric amounts, such as alloys of predominantly the beta ($\beta$) NiAl phase, with possible additions of solid solution strengthening elements such as hafnium, tantalum, yttrium, rhenium and molybdenum.

The environmental coating of this invention generally includes one or more metals that have been diffused into the surface of the nickel aluminide component, and an aluminum oxide layer on the surface of the nickel aluminide component. According to this invention, suitable metals are the noble metals (particularly platinum, palladium and rhodium), elemental chromium and an MCr alloy where M is nickel, cobalt and/or iron, which form a diffusion region comprising noble metal-aluminides and/or chromium-aluminides. The environmental coating may optionally contain one or more oxygen-active elements, such as the rare earth elements yttrium, hafnium, zirconium and cerium.

According to this invention, the environmental coating need only consist of the diffusion region and the aluminum oxide layer, and therefore does not require additional environmentally-resistant layers (e.g., diffusion aluminides or MCrAlY coatings of the prior art) to protect the underlying NiAl substrate. Instead, the diffusion region of the environmental coating is sufficiently formed by the large reservoir of aluminum provided by the component itself, and therefore does not require an aluminized region or aluminum-containing layer on the surface of the nickel aluminide component.

Processing steps for this invention generally include depositing and then appropriately diffusing the one or more additive metals into the surface of the nickel aluminide alloy, and then forming an aluminum oxide layer on the nickel aluminide alloy. If desired, a ceramic layer can be deposited on the oxide layer to provide thermal insulation for the NiAl component. The metal may be deposited on the component using various processes known in the art. Prior to developing the oxide layer, the surface of the nickel aluminide alloy is preferably treated to have a surface finish of not greater than about 50 microinches (about 1.25 micrometers) $R_a$.

According to this invention, an NiAl component protected by the environmental coating described above is capable of exhibiting significantly improved service life in hostile environments where the component would otherwise be susceptible to degradation of its mechanical properties due to hot corrosion attack. Notably, this invention completely omits a traditional aluminum-based bond coat, instead using the NiAl component as the reservoir from which an oxidation-resistant alumina scale is grown. It is believed that improved hot corrosion resistance is achieved for NiAl alloys as a result of the diffusion layer of this invention compensating for the inability of an alumina scale to provide adequate protection from hot corrosion in the presence of salt deposits. The result is an environmental coating that has been surprisingly found to increase the service life of an NiAl component by as much as five times greater than that possible without the environmental coating.

Other objects and advantages of this invention will be better appreciated from the following detailed description.

DETAILED DESCRIPTION OF THE DRAWINGS

Figure 1:
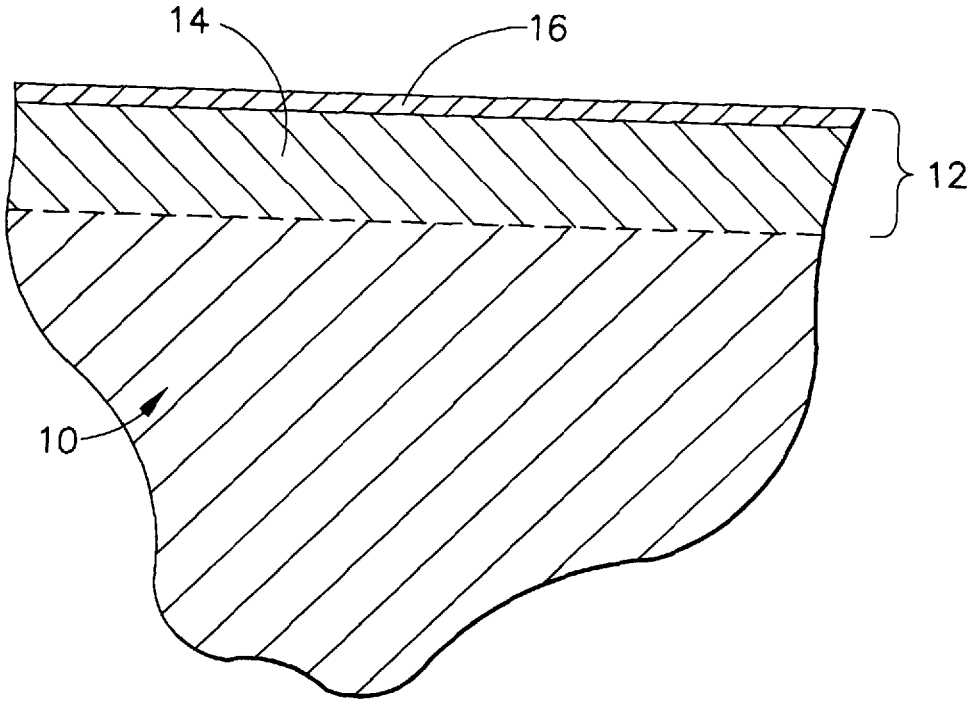

The present invention will now be described, by way of example, with reference to the accompanying drawings, in which FIG. 1 is a cross-sectional view of a gas turbine engine component having an environmental coating in accordance with this invention.

DETAILED DESCRIPTION OF THE INVENTION

The present invention is generally applicable to components formed from nickel aluminide alloys and designed to operate within environments characterized by relatively high temperatures, such that the components are subjected to a hostile operating environment. Notable examples of such components include the high and low pressure turbine vanes and blades, shrouds, combustor liners and augmentor hardware of gas turbine engines. This invention is particularly directed to gas turbine engine components whose surfaces are exposed to hot combustion gases during the operation of the gas turbine engine, and are therefore subjected to severe attack by oxidation, corrosion and erosion. In operating environments where sodium will be present, as is the case when the engine is operating in sea air, such components are particularly susceptible to hot corrosion by the formation of salt deposits on those surfaces exposed to the combustion gases.

A nickel aluminide component 10 is represented in FIG. 1 as including an environmental coating 12 in accordance with this invention. As shown, the coating 12 includes a diffusion region 14 in the surface of the component 10, over which an aluminum oxide (alumina) layer 16 has been grown. A preferred material for the component 10 is a nickel aluminide alloy of predominantly the beta NiAl phase, which may be in the form of a single-crystal casting that forms the entire component 10. Alternatively, it is foreseeable that the nickel aluminide alloy could be limited to a thick layer on the surface of the component 10, which in turn might be formed of a suitable high-temperature material, such as a nickel or cobalt-base superalloy. A minimal thickness for an NiAl layer is about 125 micrometers in order to provide an adequate supply of aluminum for oxide formation.

A novel feature of this invention is the development of an environmental coating 12 that has been found to drastically increase the hot corrosion resistance of nickel aluminide alloys, which are otherwise prone to hot corrosion attack even though a protective alumina scale is present on the surface of the alloy. Furthermore, the environmental coating 12 of this invention does not entail conventional bond coat layers, such as the diffusion aluminide and MCrAlY alloys conventionally required in the prior art. Instead, the environmental coating 12 is composed primarily of the diffusion region 14, which is formed by depositing a noble metal, elemental chromium and/or an MCr alloy (where M is nickel, cobalt and/or iron) on the surface of the component 10, and then diffusing the deposited metal into the surface to form aluminides that are capable of improving the resistance of the NiAl component 10 to hot corrosion attack.

Following diffusion, the aluminum oxide layer 16 is grown on the surface, with aluminum for the oxide layer 16 being drawn from the large reservoir of aluminum provided by the NiAl component 10. Thereafter, the component 10 can be placed in service, or an optional ceramic layer (not shown) can be deposited on the oxide layer 16, such that the environmental coating 12 would serve as a bond coat. However, in this role the environmental coating 12 would differ from prior art bond coats, which have been formed by aluminizing the surface of a superalloy component, or by depositing an environmentally-resistant layer (e.g., an MCrAlY coating) on the surface of a component.

As noted above, the component 10 is a nickel aluminide alloy, such as a binary NiAl alloy consisting essentially of nickel and aluminum in stoichiometric amounts. Alternatively, the nickel aluminide alloy may contain selected elements, such as hafnium, tantalum, yttrium, rhenium, zirconium and/or molybdenum to improve the mechanical and/or physical properties of the component 10, or one or more oxygen-active elements, such as yttrium, hafnium, cerium, zirconium and others, to promote adherence of the aluminum oxide layer 16. Alternatively, oxygen-active elements can be introduced with the diffusion metal of the environmental coating 12, as will be discussed below. Notably, there appears to be unique and unexpected interactions that occur between NiAl and the diffusion region 14. Specifically, the diffusion metals of this invention have been found to inhibit the formation of nickel oxide at the surface of the component 10, resulting in enhanced hot corrosion resistance. In addition, platinum as the noble metal diffusion substantially increases the diffusion rate of aluminum, thereby promoting the formation of the desired aluminum oxide layer 16.

Processing of the environmental coating 12 of this invention is generally as follows. After forming the component 10, one or more of the above-noted noble metal, chromium or MCr alloys are deposited on the surface of the component. Suitable deposition processes for noble metals, such as platinum, include electroplating, sputtering and metallo-organic chemical vapor deposition (CVD) techniques, while suitable deposition processes for elemental chromium and MCr alloys include electroplating, sputtering, pack cementation and chemical vapor deposition, with thermal spraying also being suitable for depositing MCr alloys such as FeCr, CoCr, NiCr and NiCoCr. The environmental coating 12 may be formed to further include up to about 1.0 atomic percent of one or more oxygen-active elements by depositing such elements with, before or after the deposition of the metal. For example, chromium and one or more active elements can be simultaneously codeposited and diffused into the component 10 by such methods as chemical vapor deposition (CVD), pack cementation and out-of-pack (gas or vapor phase deposition) processes. In addition, noble metals and active elements can be applied simultaneously by sputtering, and then diffused into the component surface. Alternatively, a noble metal can be deposited by electroplating and an active element by pack cementation or sputtering, with the resulting combination then being diffused into the component surface to form the diffusion region 14. In the latter example, the active element could be deposited prior to deposition of the noble metal. It is also within the scope of this invention that the active element constituent of the environmental coating 12 could be provided by the underlying NiAl substrate.

Diffusion of the metal and any optional active elements is performed by heating the component to a temperature of about 1800° to about 2050° F. (about 980° to about 1120° C.) for a duration of about one to about four hours. The result is the formation of the diffusion region 14, whose composition will include at least one intermetallic, e.g., noble metal-aluminides or chromium-aluminides, depending on the diffusion metal. For example, diffusing platinum into the NiAl surface forms PtAl intermetallic phases, usually $PtAl_2$, while desirable intermetallics that can form with the diffusion of elemental chromium or one of the above-noted MCr alloys include FeCrAlY, NiCoCrAlY, NiCrAlY and CoCrAlY. The aluminum oxide layer 16 is then formed on the surface of the component 10 during subsequent thermal processing of the component 10 or by a specific treatment intended to form the desired oxide layer 16, as would be understood by those skilled in the art.

Prior to formation of the oxide layer 16, the surface of the component 10 may be processed so as to have a surface finish of not greater than about 50 microinches $R_a$ (about 1.25 micrometers). According to this invention, a very smooth, contaminant-free surface on an NiAl substrate processed in accordance with the above is less susceptible to salt deposition and impaction.

In accordance with the above, the NiAl component 10 protected by the environmental coating 12 of this invention is capable of exhibiting enhanced service life in hostile environments where the NiAl component would otherwise be subject to degradation of its mechanical properties due to hot corrosion attack. Notably, the environmental coating 12 does not include a traditional aluminum-based bond coat material, such as a diffusion aluminide or MCrAlY coating, but instead uses the NiAl component 10 as a reservoir for the oxidation-resistant alumina oxide layer 16, and utilizes the diffusion region 14 to compensate for the inability of the oxide layer 16 to adequately protect the NiAl component 10 from hot corrosion attack. The result is an environmental coating 10 that has been surprisingly determined through testing to increase the service life of an NiAl alloy by as much as five times greater than that possible without the environmental coating.

While our invention has been described in terms of a preferred embodiment, it is apparent that other forms could be adopted by one skilled in the art. Accordingly, the scope of our invention is to be limited only by the following claims.

What is claimed is:

1. A component having at least a body portion that consists essentially of nickel aluminide, the body portion having an environmental coating protecting a surface thereof, the environmental coating consisting of:

a metal diffused into the surface of the body portion so as to form a diffusion region starting at the surface of the body portion and extending into the body portion, the metal being at least one element chosen from the group consisting of noble metals, chromium, and MCr alloys where M is nickel, cobalt and/or iron, the diffusion region containing nickel aluminide and at least one intermetallic chosen from the group consisting of noble metal-aluminides and chromium-aluminides; and an aluminum oxide layer on and contacting the surface of the body portion.

2. A component as recited in claim 1, wherein the component consists essentially of a binary NiAl alloy consisting essentially of nickel and aluminum in stoichiometric amounts.

3. A component as recited in claim 1, wherein the component consists essentially of a single-crystal beta-phase nickel aluminide alloy.

4. A component as recited in claim 1, wherein the environmental coating contains up to about 1.0 atomic percent of at least one oxygen-active element.

5. A component as recited in claim 1, wherein the metal is an MCr alloy chosen from the group consisting of FeCr, CoCr, NiCr and NiCoCr.

6. A component as recited in claim 5, wherein the environmental coating contains up to about 1.0 atomic percent of at least one oxygen-active element.

7. A component as recited in claim 5, wherein the diffusion region comprises at least one alloy chosen from the group consisting of FeCrAlY, NiCoCrAlY, NiCrAlY and CoCrAlY.

8. A component as recited in claim 1, wherein the intermetallic in the diffusion region is formed without aluminization of the surface of the body portion.

9. A method for forming an environmental coating on a surface of at least a body portion of a component, the body portion consisting essentially of nickel aluminide, the method comprising the steps of:

depositing a metal on the surface of the body portion, the metal being at least one element chosen from the group consisting of noble metals, chromium, and MCr alloys where M is nickel, cobalt and/or iron;

diffusing the metal into the surface so as to form a diffusion region starting at the surface of the body portion and extending into the body portion, the diffusion region containing nickel aluminide and at least one intermetallic chosen from the group consisting of noble metal-aluminides and chromium-aluminides;

processing the surface of the body portion to have a surface finish of not greater than about 50 microinches $R_a$; and forming an aluminum oxide layer on the surface of the body portion;

wherein the environmental coating consists of the diffusion region and the aluminum oxide layer.

10. A method as recited in claim 9, wherein the component consists essentially of a binary NiAl alloy consisting essentially of nickel and aluminum in stoichiometric amounts and optional additions of one or more solid solution strengthening elements.

11. A method as recited in claim 9, wherein the intermetallic in the diffusion region is formed without aluminizing the surface of the body portion.

12. A method as recited in claim 9, wherein the environmental coating contains up to about 1.0 atomic percent of at least one oxygen-active element.

13. A method as recited in claim 9, wherein the metal is platinum and the depositing step entails a process chosen from the group consisting of electroplating, sputtering and metallo-organic CVD.

14. A method as recited in claim 9, wherein the metal is an MCr alloy chosen from the group consisting of FeCr, CoCr, NiCr and NiCoCr.

15. A method as recited in claim 14, wherein the environmental coating contains up to about 1.0 atomic percent of at least one oxygen-active. element.

16. A method as recited in claim 14, wherein the diffusion region comprises at least one alloy chosen from the group consisting of FeCrAlY, NiCoCrAlY, NiCrAlY and CoCrAlY.

17. A method as recited in claim 9, wherein the metal is chromium or an MCr alloy and the depositing step entails a process chosen from the group consisting of electroplating, sputtering, pack cementation, chemical vapor deposition and thermal spraying.

* * * * *